US009888775B1

(12) United States Patent
Chen et al.

(10) Patent No.: US 9,888,775 B1
(45) Date of Patent: Feb. 13, 2018

(54) CABINET WITH SLIDING DOORS

(71) Applicants: Kung-Cheng Chen, Taichung (TW); Lung-Chuan Huang, Taichung (TW)

(72) Inventors: Kung-Cheng Chen, Taichung (TW); Lung-Chuan Huang, Taichung (TW)

(73) Assignee: E-MAKE CO., LTD., Taichung (TW)

( * ) Notice: Subject to any disclaimer, the term of this patent is extended or adjusted under 35 U.S.C. 154(b) by 0 days.

(21) Appl. No.: 15/369,049

(22) Filed: Dec. 5, 2016

(51) Int. Cl.

| | |
|---|---|
| ***A47B 88/00*** | (2017.01) |
| ***A47B 96/00*** | (2006.01) |
| ***A47B 67/04*** | (2006.01) |
| ***A47B 88/483*** | (2017.01) |
| ***A47F 7/00*** | (2006.01) |
| ***E06B 7/28*** | (2006.01) |
| ***E06B 5/00*** | (2006.01) |

(52) U.S. Cl.
CPC ..... *A47B 96/00* (2013.01); *A47B 67/04* (2013.01); *A47B 88/483* (2017.01); *A47F 7/00* (2013.01); *E06B 5/006* (2013.01); *E06B 7/28* (2013.01)

(58) Field of Classification Search
CPC ..... A47B 96/00; A47B 88/483; A47B 67/04; A47F 7/00; E06B 5/006; E06B 7/28
USPC ..... 312/138.1, 139.2, 304
See application file for complete search history.

(56) References Cited

U.S. PATENT DOCUMENTS 1,721,132 A * 7/1929 Orthwine ..... A47F 3/125 220/287
1,744,070 A * 1/1930 Deacon ..... A47F 3/0434 217/59
1,968,654 A * 7/1934 Rodgers ..... A47F 3/0404 220/592.02
2,192,519 A * 3/1940 King ..... A47F 3/043 312/139.2
2,227,854 A * 1/1941 Walters ..... A47F 3/005 312/114
2,230,460 A * 2/1941 Kleinwachter ..... A47F 3/001 222/113
2,233,559 A * 3/1941 Shields ..... A47F 7/02 312/119
4,335,864 A * 6/1982 Merlini ..... A47G 25/08 24/457
5,069,512 A * 12/1991 Sykes ..... A47F 3/005 248/205.3
5,690,402 A * 11/1997 Koppe ..... A47F 3/004 312/114
5,857,757 A * 1/1999 Bieker ..... A47B 67/04 206/373
6,830,299 B2 * 12/2004 Henriott ..... E05D 15/0643 312/139.2
8,430,460 B2 * 4/2013 Erro ..... A47F 3/043 16/414
2002/0084727 A1 * 7/2002 Miller ..... A47B 81/061 312/205
2008/0302016 A1 * 12/2008 Halfon ..... E05D 15/0652 49/130
2013/0285518 A1 * 10/2013 Stelmasik ..... A47F 3/005 312/139.2

(Continued)

*Primary Examiner* — Hanh V Tran

(57) ABSTRACT

A cabinet is provided with a housing including a rear wall, a first side wall, a second side wall opposite to the first side wall, a bottom, a top frame member, and a front frame member, and two sliding doors, each disposed on the top frame member, the front frame member, and one of the first and second side walls. The housing is shaped as a truncated trapezoid in its side elevation.

1 Claim, 10 Drawing Sheets

(56) References Cited

U.S. PATENT DOCUMENTS

| | | | | |
|---|---|---|---|---|
| 2015/0115786 | A1* | 4/2015 | Manalang | B25H 3/028 312/321.5 |
| 2016/0090770 | A1* | 3/2016 | Girotto | E05D 15/0652 312/319.1 |
| 2017/0175994 | A1* | 6/2017 | Kowash | F21V 33/006 |

* cited by examiner

CABINET WITH SLIDING DOORS

BACKGROUND OF THE INVENTION

1. Field of the Invention

The invention relates to cabinets and more particularly to such a cabinet having two sliding doors.

2. Description of Related Art

Conventionally, a cabinet has two hinged doors. Articles, documents, etc. are stored in the cabinet. Also, a lock is provided on a joining portion of the doors. For example, there is a conventional cabinet including a housing, a hinged first door, and a hinged second door.

However, a large outer space is required when opening the hinged doors. Also, the hinges are complicated. Further, it is subject to malfunction.

Thus, the need for improvement still exists.

SUMMARY OF THE INVENTION

It is therefore one object of the invention to provide a cabinet comprising a housing including a rear wall, a first side wall, a second side wall opposite to the first side wall, a bottom, a top frame member, and a front frame member wherein the housing is shaped as a truncated trapezoid in its side elevation; and two sliding doors, each disposed on the top frame member, the front frame member, and one of the first and second side walls.

In a first aspect of the invention, space for opening or closing the cabinet is decreased to a minimum.

In a second aspect of the invention, assembly of the cabinet is made easy due to simplified components.

In a third aspect of the invention, a plurality of drawers are provided in the cabinet.

In a fourth aspect of the invention, the sliding doors are inclined for attracting consumers.

In a fifth aspect of the invention, an inclined angle of the sliding door can be changed depending on applications.

In a sixth aspect of the invention, the sliding door can be enlarged for providing an additional space.

The above and other objects, features and advantages of the invention will become apparent from the following detailed description taken with the accompanying drawings.

DETAILED DESCRIPTION OF THE INVENTION

Figure 1:
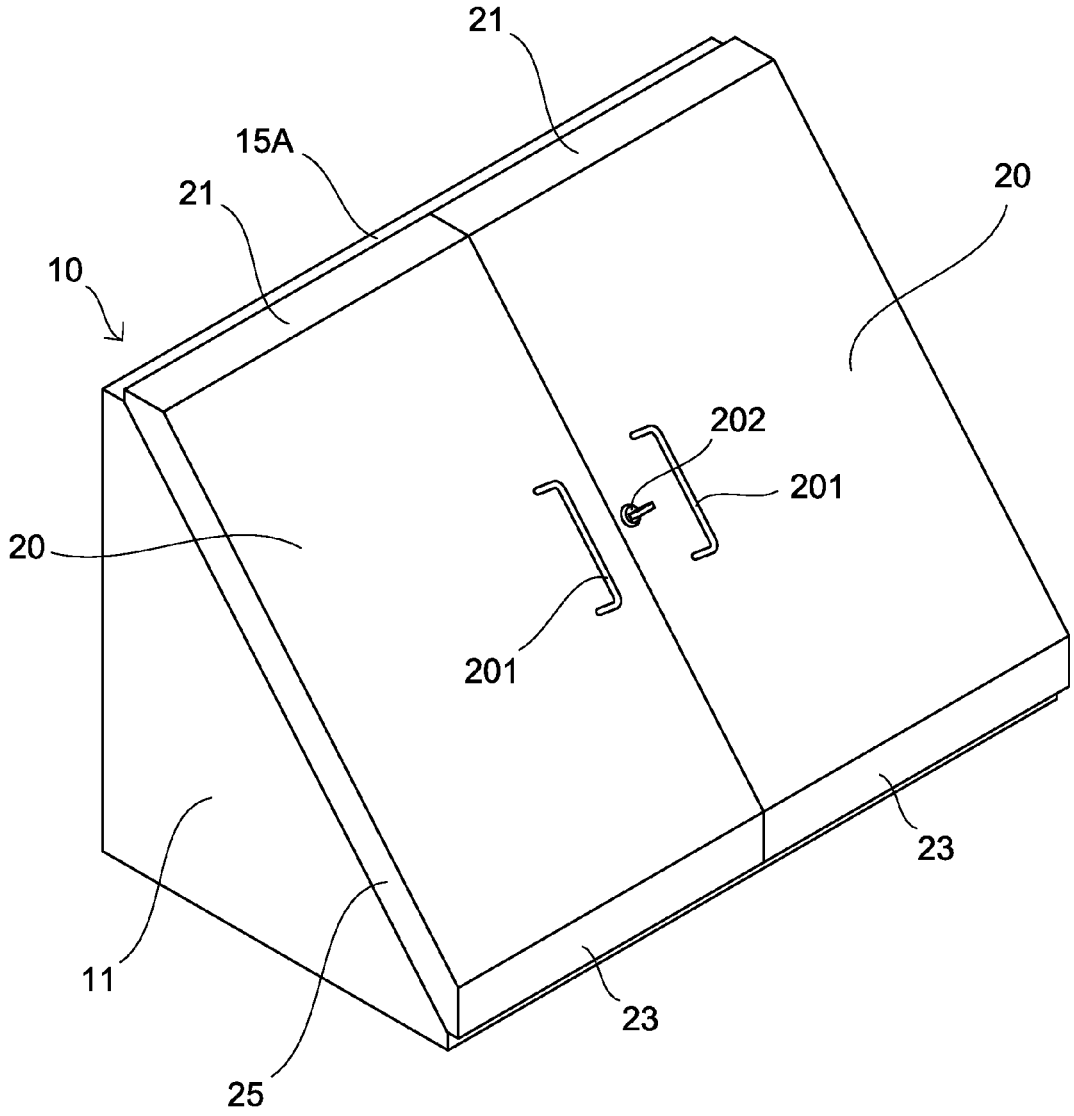
FIG. 1 is a perspective view of a cabinet according to a first preferred embodiment of the invention, the cabinet being closed.
Figure 2:
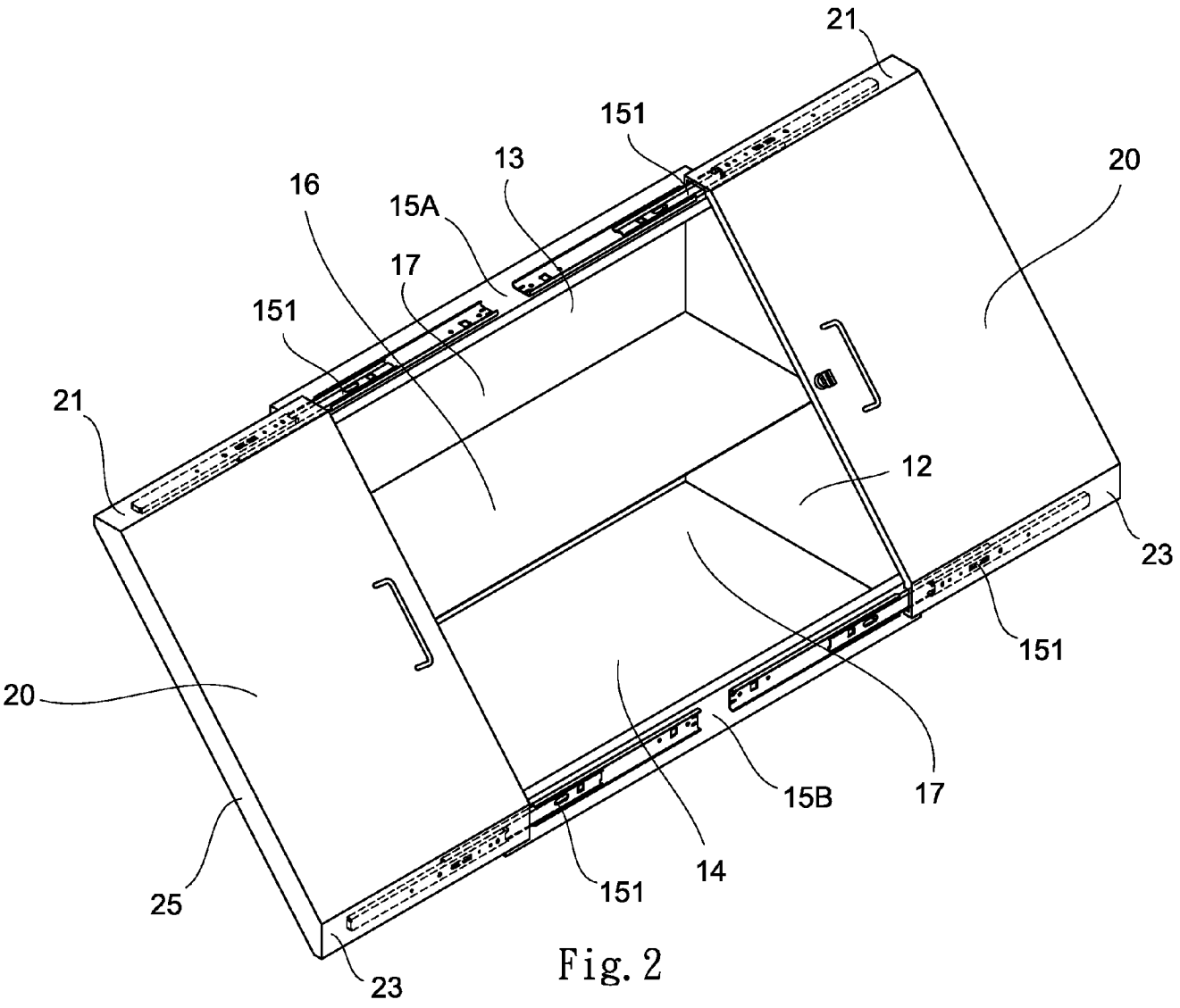
FIG. 2 is a view similar to FIG. 1 with the cabinet being open.
Figure 3:
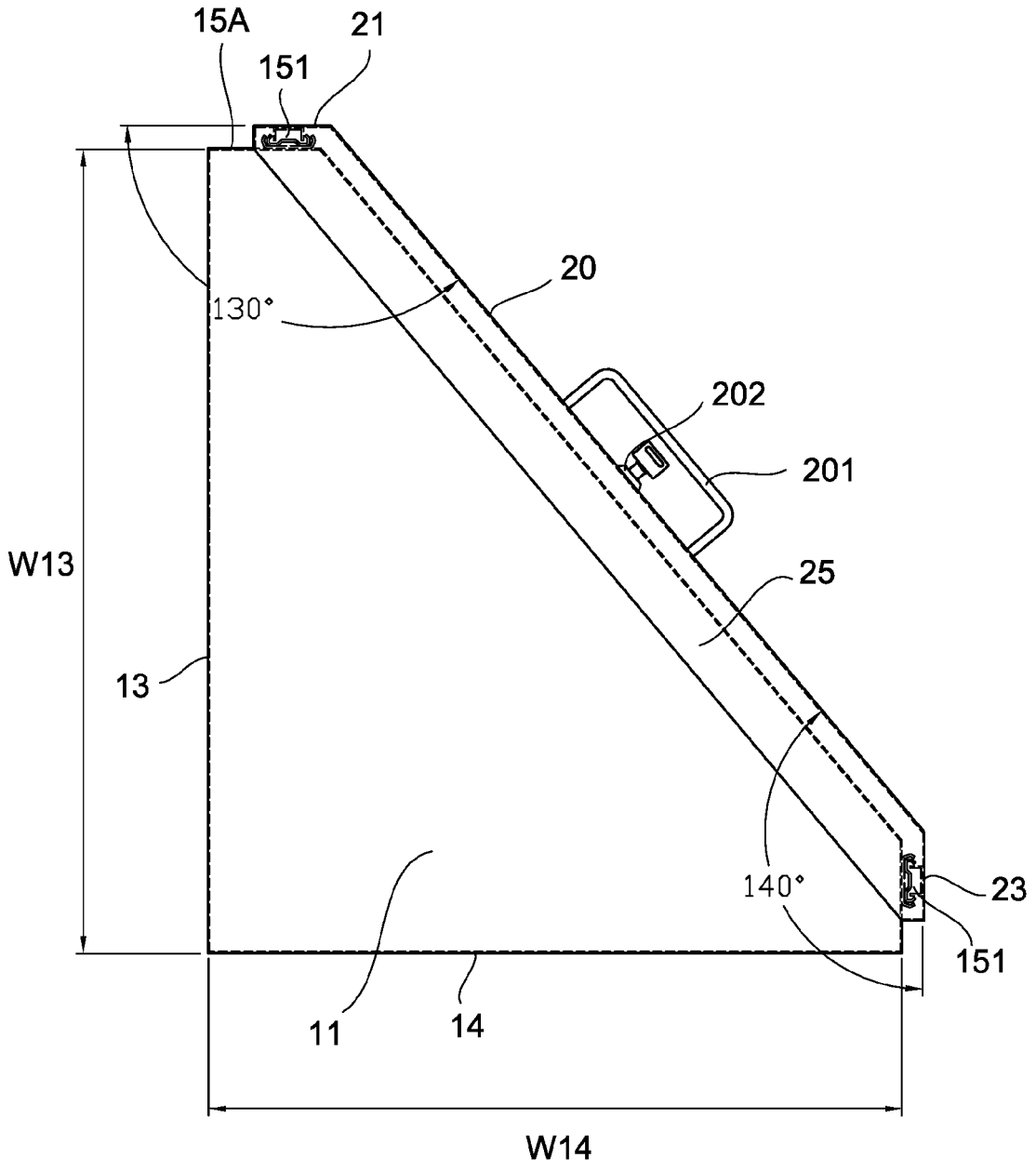
FIG. 3 is a side elevation of FIG. 1 showing width of the rear wall greater than that of the bottom.
Figure 4:
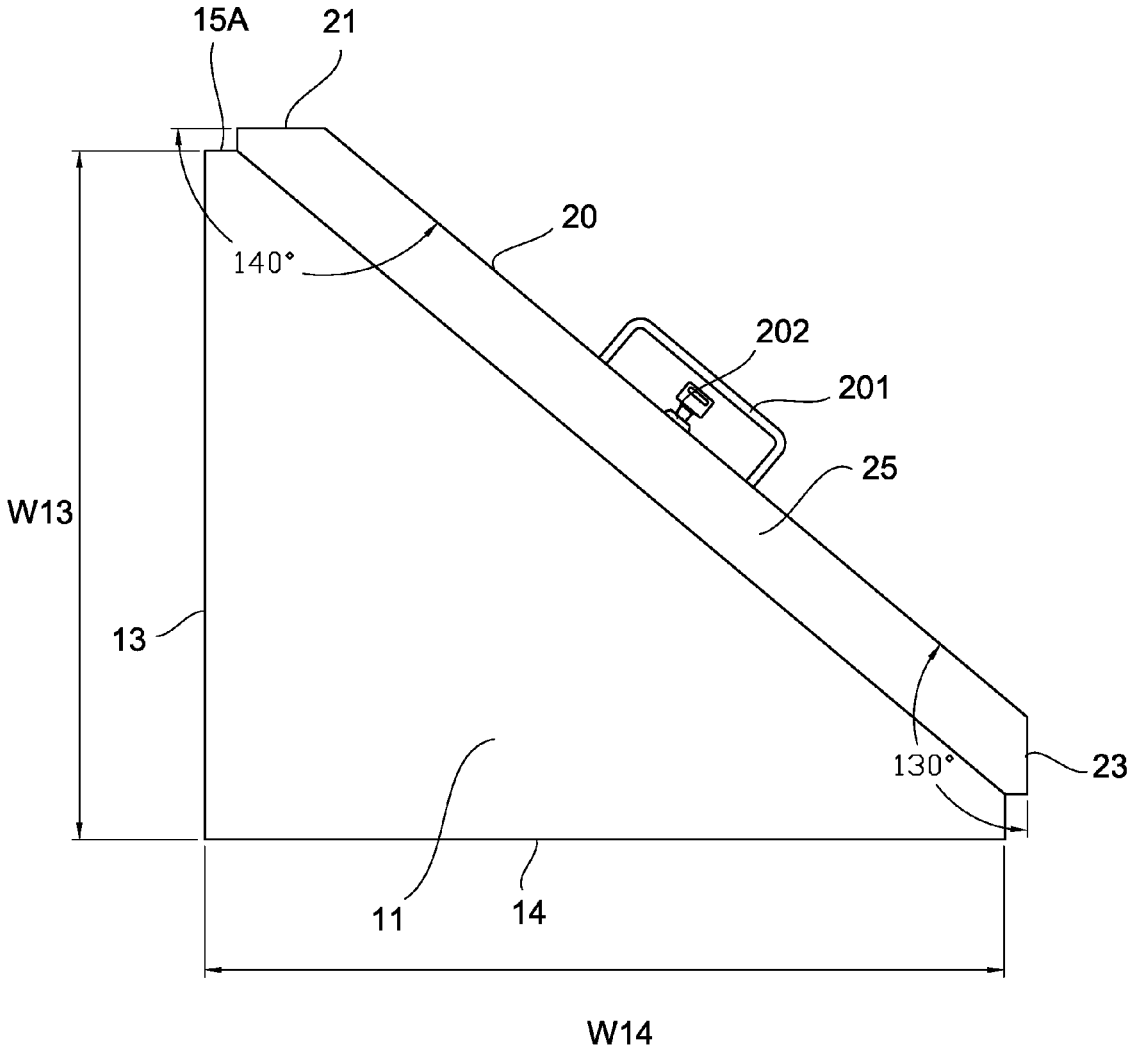
FIG. 4 is a view similar to FIG. 3 showing width of the rear wall less than that of the bottom.
Figure 5:
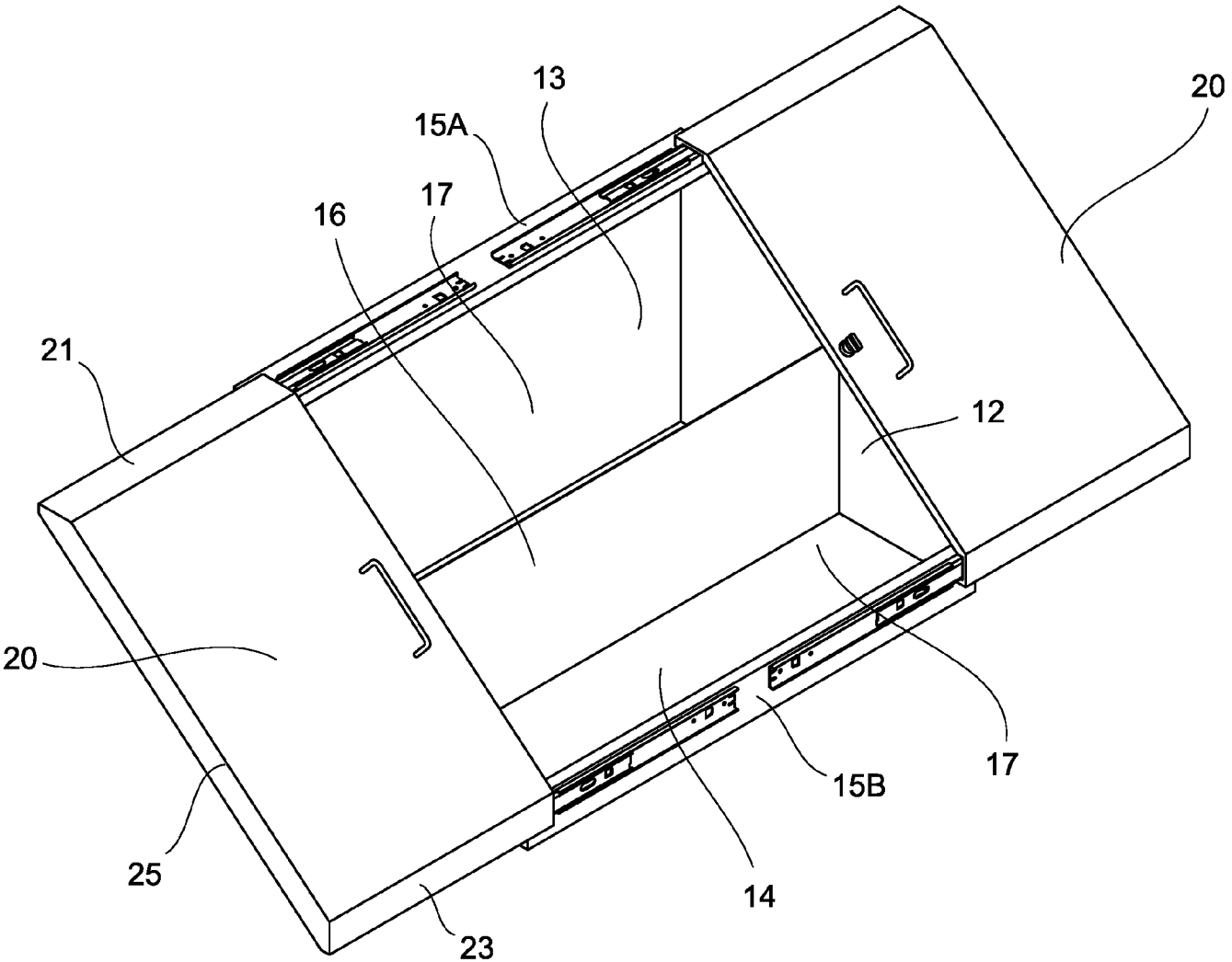
FIG. 5 is a view similar to FIG. 2 showing the shelf being perpendicular to the bottom.

Referring to FIGS. 1 to 5, a cabinet in accordance with a first preferred embodiment of the invention comprises a housing 10 and two sliding doors 20. The housing 10 includes a rear wall 13, a first side wall 11, a second side wall 12 opposite to the first side wall 11, a bottom 14, a top frame member 15A, and a front frame member 15B. The housing 10 is shaped as a truncated trapezoid in its side elevation (see FIG. 3). A shelf 16 is provided in the housing 10 for dividing an internal space of the housing 10 into two compartments 17. The shelf 16 may be oriented horizontally (see FIG. 2) or vertically (see FIG. 5).

The sliding door 20 is inclined and disposed between the top frame member 15A and the front frame member 15B. The sliding door 20 includes a top member 21, a front member 23, and a side member 25. A handle 201 is provided on the sliding door 20. A lock 202 is provided on the right sliding door 20. The top member 21 is disposed at an elevation higher than that of the top frame member 15A (i.e., there is a shoulder between the top member 21 and the top frame member 15A). Also, the front member 23 is disposed in front of the front frame member 15B (i.e., there is a shoulder between the front member 23 and the front frame member 15B). A slide 151 is provided on the top frame member 15A and the front frame member 15B respectively. Thus, the sliding doors 20 are configured to open by sliding away from each other by sliding along the slides 151 by holding the handles 201 or close by sliding toward each other by sliding along the slides 151 by holding the handles 201. It is envisaged by the invention that only a small outer space is required for accommodating the open sliding doors 20.

Width W13 of the rear wall 13 can be equal to, greater than (see FIG. 3), or less than (see FIG. 4) width W14 of the bottom 14. An angle between the top member 21 and the inclined surface 20 is between 130-degree (see FIG. 3) and 140-degree (see FIG. 4). An angle between the front member 23 and the inclined surface 20 is between 140-degree (see FIG. 3) and 130-degree (see FIG. 4).

Figure 6:
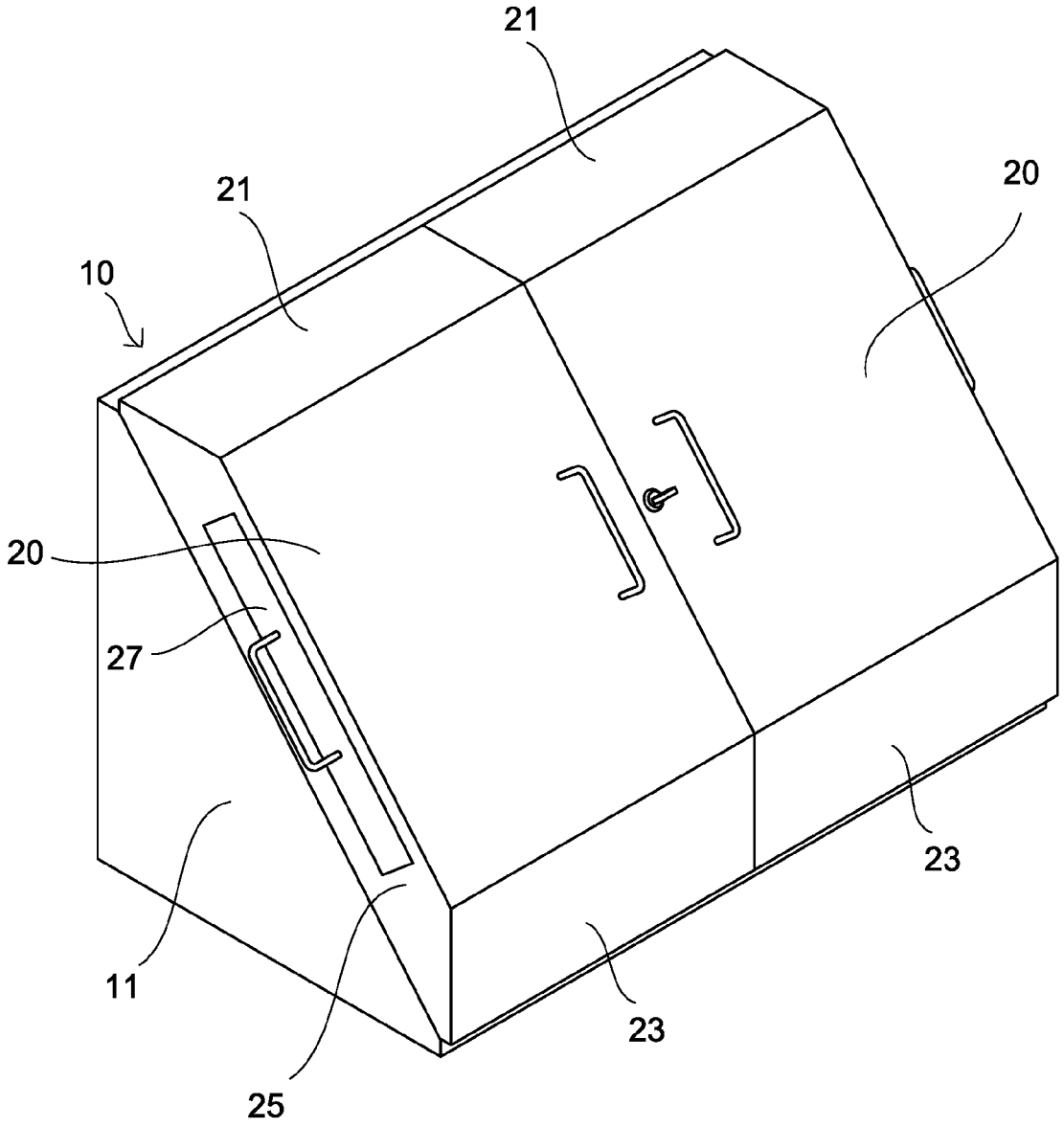
FIG. 6 is a perspective view of a cabinet according to a second preferred embodiment of the invention, the cabinet being closed.
Figure 6A:
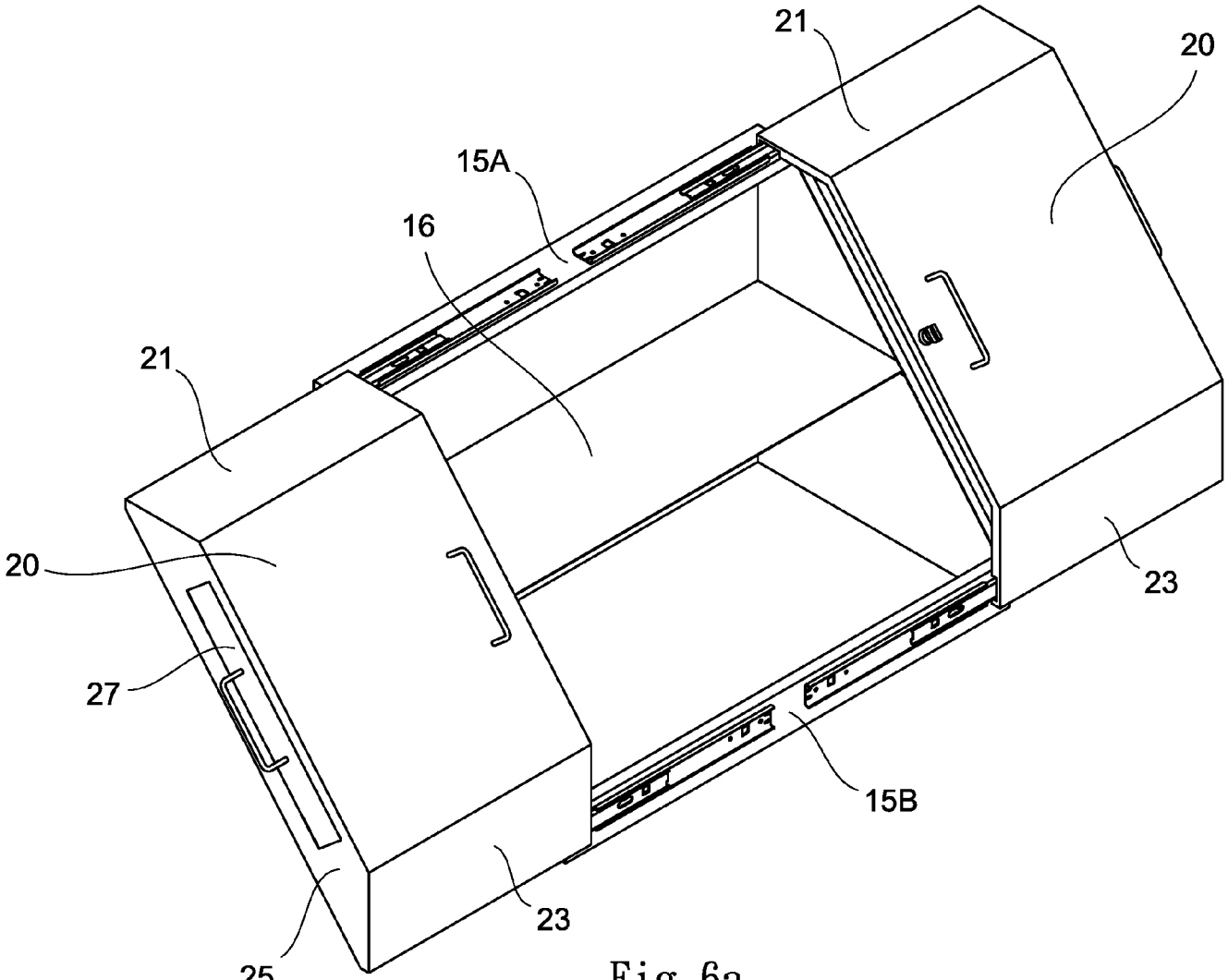
FIG. 6A is a view similar to FIG. 6 with the cabinet being open.
Figure 6B:
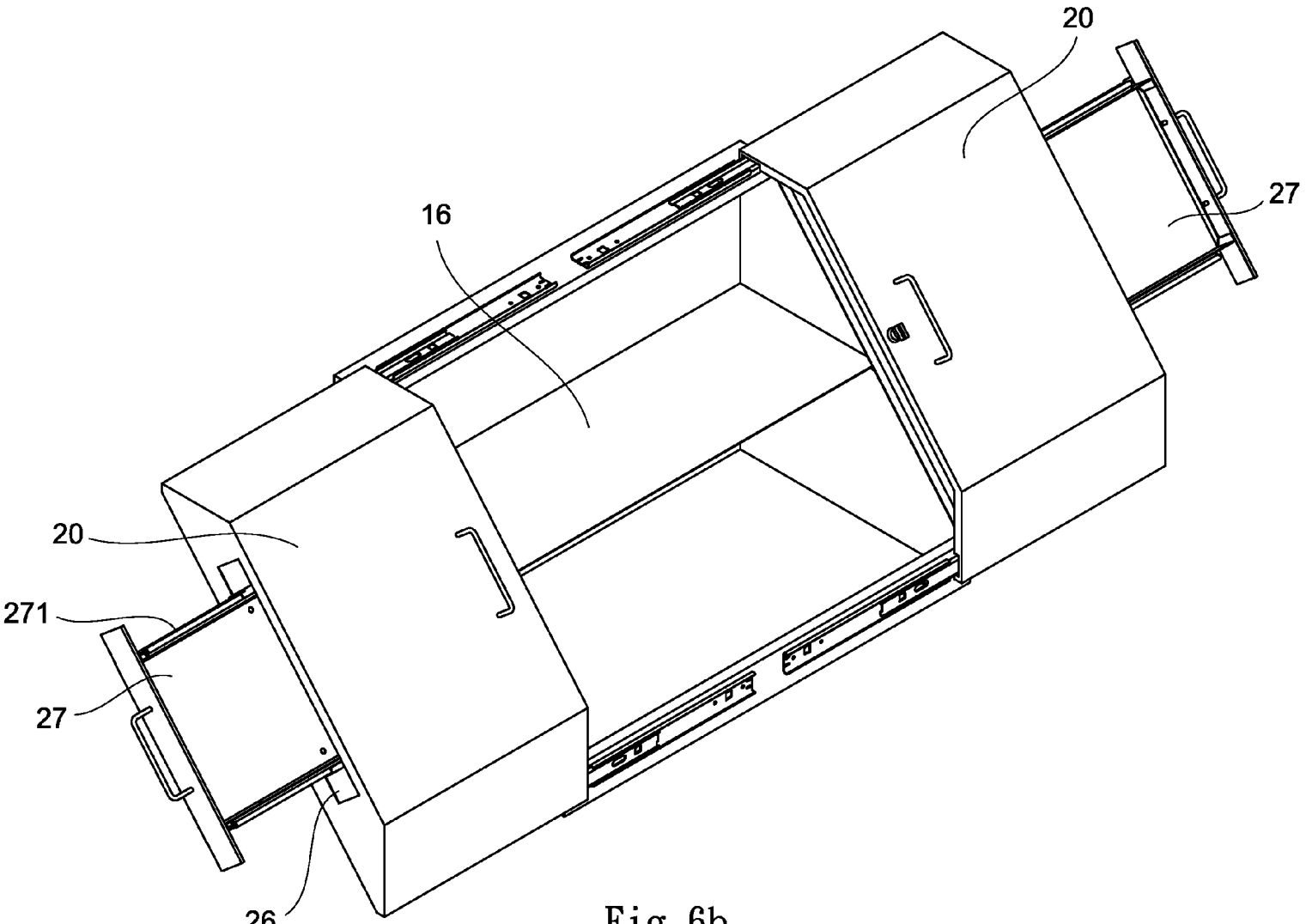
FIG. 6B is a view similar to FIG. 6A with the drawers being drawn out.
Figure 6C:
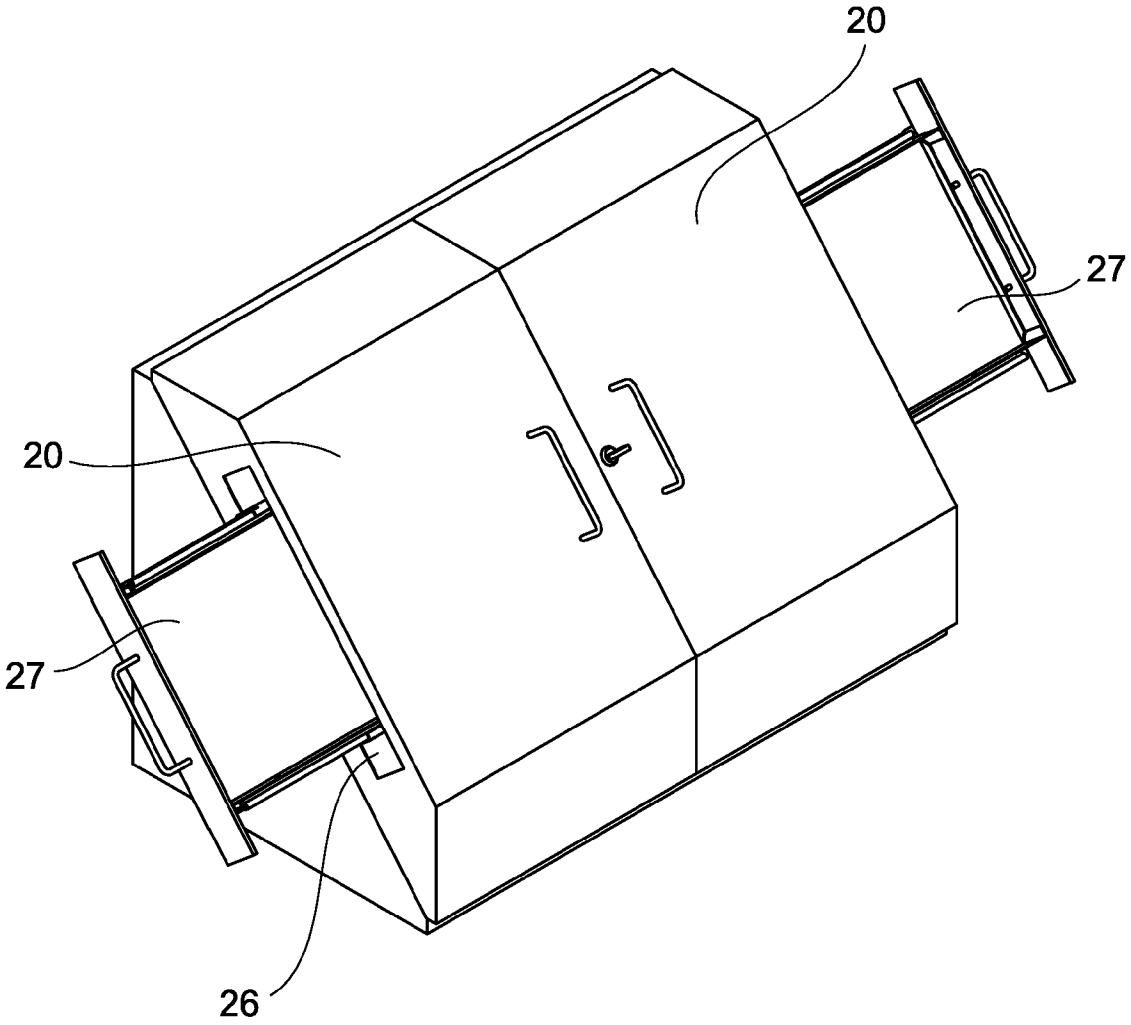
FIG. 6C is a view similar to FIG. 6B with the cabinet being closed by pulling the sliding doors toward each other.

Referring to FIGS. 6 to 6C, a cabinet in accordance with a second preferred embodiment of the invention is shown. The characteristics of the second preferred embodiment are substantially the same as that of the first preferred embodiment except the following: The side member 25, the front member 23, and the top member 21 of the sliding door 20 are enlarged to provide a space 26 for installing a drawer 27. The drawer 27 has two slides 271 on two sides respectively so that the drawer 27 is configured to draw out of the side member 25 or retract into the side member 25.

Figure 7:
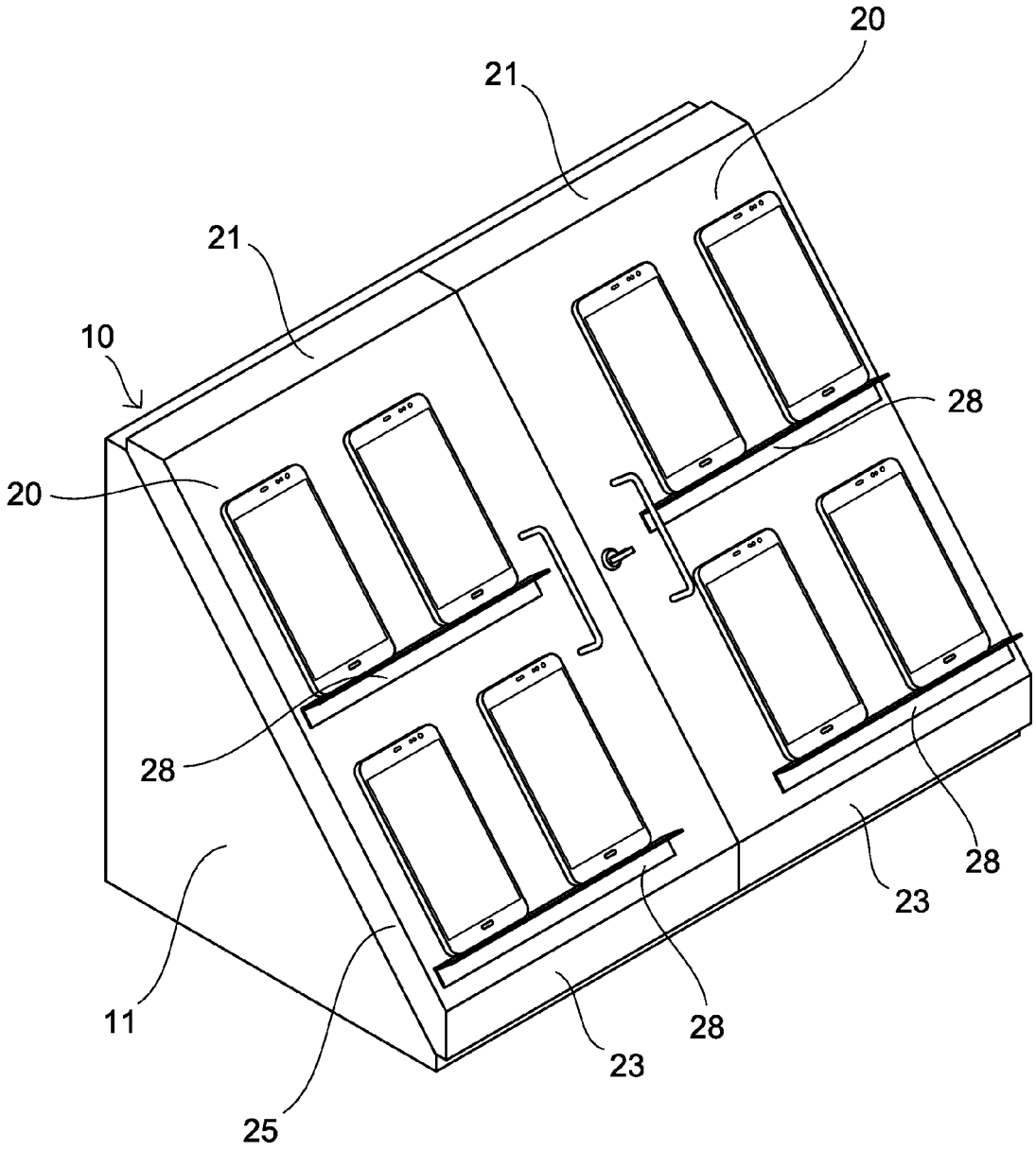
FIG. 7 is a perspective view of a cabinet according to a third preferred embodiment of the invention, the cabinet being closed.

Referring to FIG. 7, a cabinet in accordance with a third preferred embodiment of the invention is shown. The characteristics of the third preferred embodiment are substantially the same as that of the first preferred embodiment except the following: Two rows of two stands 28 are provided on an outer surface of the sliding door 20. Articles such as mobile phones can be placed on the stands 28.

While the invention has been described in terms of preferred embodiments, those skilled in the art will recognize that the invention can be practiced with modifications within the spirit and scope of the appended claims.

What is claimed is:

1. A cabinet comprising:

a housing including a rear wall, a first side wall, a second side wall opposite to the first side wall, a bottom, a top frame member, and a front frame member wherein the housing is shaped as a truncated trapezoid in its side elevation;

two sliding doors, each disposed on the top frame member, the front frame member, and one of the first and second side walls, and each sliding door including a top member, a front member, and a side member on its edge;

two spaces, each disposed in the side member, the front member, and the top member of the sliding door; and two drawers, each disposed in the space and including two slides on two sides respectively.

* * * * *